US006111482A

United States Patent [19]

Atokawa

[11] Patent Number: 6,111,482

[45] Date of Patent: Aug. 29, 2000

[54] DIELECTRIC VARIABLE-FREQUENCY FILTER HAVING A VARIABLE CAPACITANCE CONNECTED TO A RESONATOR

[75] Inventor: Masayuki Atokawa, Kanazawa, Japan

[73] Assignee: Murata Manufacturing Co., Ltd., Japan

[21] Appl. No.: 09/087,304

[22] Filed: May 29, 1998

[30] Foreign Application Priority Data

May 30, 1997 [JP] Japan ..... 9-141424
Apr. 9, 1998 [JP] Japan ..... 10-097879

[51] Int. Cl.[7] ..... H01P 1/20; H01P 1/213; H01P 1/202

[52] U.S. Cl. ..... 333/202; 333/206; 333/207; 333/223; 333/134

[58] Field of Search ..... 333/202, 206, 333/207, 222, 223, 174, 175, 126, 134

[56] References Cited

U.S. PATENT DOCUMENTS

| | | | |
|---|---|---|---|
| 4,980,660 | 12/1990 | Nakamura et al. | 333/207 X |
| 5,055,808 | 10/1991 | Walker et al. | 333/207 |
| 5,065,120 | 11/1991 | Munn | 333/207 |
| 5,227,748 | 7/1993 | Sroka | 333/207 |
| 5,392,011 | 2/1995 | Li | 333/175 X |
| 5,495,215 | 2/1996 | Newell et al. | 333/207 X |
| 5,502,422 | 3/1996 | Newell et al. | 333/207 |
| 5,543,764 | 8/1996 | Turunen et al. | 333/207 X |

FOREIGN PATENT DOCUMENTS

| | | | |
|---|---|---|---|
| 7-321509 | 12/1995 | Japan | 333/207 |
| 8-186406 | 7/1996 | Japan | 333/207 |
| 11-97905 | 4/1999 | Japan . | |
| 9427376 | 11/1994 | WIPO . | |

OTHER PUBLICATIONS

European Search Report dated Sep 2, 1998.

*Primary Examiner*—Robert Pascal
*Assistant Examiner*—Barbara Summons
*Attorney, Agent, or Firm*—Ostrolenk, Faber, Gerb, & Soffen, LLP

[57] ABSTRACT

A dielectric resonator 5 is electrically connected to an input terminal 1 through a coupling capacitor C1. A dielectric resonator 6 is electrically connected to an output terminal 2 through a coupling capacitor C3. The dielectric resonators 5 and 6 are electrically connected to each other through a coupling capacitor C2. A voltage control terminal 3 is electrically connected to the cathode of a variable-capacitance diode D1 and to one end of the coupling capacitor C1 through a choke coil L1. The anode of the variable-capacitance diode D1 is electrically connected to the dielectric resonator 6. That is, the variable-capacitance diode D1 comprises a path interconnecting at least two of said dielectric resonators in a filter 15.

17 Claims, 6 Drawing Sheets

DIELECTRIC VARIABLE-FREQUENCY FILTER HAVING A VARIABLE CAPACITANCE CONNECTED TO A RESONATOR

BACKGROUND OF THE INVENTION

1. Technical Field of the Invention

The present invention relates to a dielectric filter, a dielectric duplexer and a communication apparatus having the dielectric filter and the dielectric duplexer.

2. Related Art of the Invention

Variable-frequency type dielectric filters such as those using variable-capacitance diodes D11 and D12 shown in FIGS. 11 and 12 have been proposed for designing portable telephone sets smaller in power consumption and in size.

FIG. 11 shows the circuit configuration of a conventional variable-frequency bandpass filter. In the circuit shown in FIG. 11, portion 1 is an input terminal; portion 2 is an output terminal; portion 3 is a voltage control terminal; components 5 and 6 are dielectric resonators; components C21, C22, and C23 are coupling capacitors; components C24 and C25 are capacitors for changing a frequency band; components D11 and D12 are variable-capacitance diodes; and components L11 and L12 are choke coils.

FIG. 12 shows the circuit configuration of a conventional variable-frequency bandstop filter. In the circuit shown in FIG. 1, portion 1 is an input terminal; portion 2 is an output terminal; portion 3 is a voltage control terminal; components 5 and 6 are dielectric resonators; components C26 and C27 are capacitors; component L10 is a coupling coil; components C28 and C29 are coupling capacitors for determining an amount of stop band attenuation; components C24 and C25 are capacitors for changing a frequency band; components D11 and D12 are variable-capacitance diodes; and components L11 and L12 are choke coils.

The dielectric filter thus arranged has a center frequency determined by the resonant frequencies of resonant systems respectively formed of the capacitances of the variable-capacitance diodes D11 and D12, the capacitances of the capacitors C24 and C25, and the dielectric resonators 5 and 6. The capacitances of the variable-capacitance diodes D11 and D12 are changed by changing a voltage applied to the voltage control terminal 3, thus enabling variable setting of the center frequency.

The conventional dielectric filters, however, have a drawback in that, since the variable-capacitance diodes D11 and D12 for variable setting of a center frequency are respectively connected to dielectric resonators 5 and 6 in parallel with the same, a deterioration is caused in $Q_o$ of the resonant systems (Q at the center frequency) by addition of the capacitances of the variable-capacitance diodes D11 and D12 in parallel with the dielectric resonators 5 and 6. If it is necessary to change the frequency of the dielectric filter by a large amount, an increase in the capacitances of the variable-capacitance diodes D11 and D12 is required. In such a case, a deterioration in $Q_o$ of the resonant systems cannot be avoided. In particular, because the insertion loss of the bandpass filter is dependent on $Q_o$ of the resonant system, a deterioration in the electrical characteristics of the bandpass filter is considerable.

SUMMARY OF THE INVENTION

It is, therefore, an object of the present invention to provide a dielectric filter and a dielectric duplexer free from any considerable deterioration in $Q_o$ of their resonant systems and having a small insertion loss and a large amount of attenuation, and a communication apparatus having the dielectric filter or duplexer.

The present invention provides a dielectric bandpass filter comprising: an input terminal, an output terminal, and a voltage control terminal; a plurality of dielectric resonators electrically connected between said input terminal and said output terminal; a variable-capacitance diode electrically connected to at least one of said plurality of dielectric resonators, the capacitance of said variable-capacitance diode being electrically changeable by a control signal from said voltage control terminal; and said variable-capacitance diode being comprised in a multipath circuit of said bandpass filter.

The present invention further provides a dielectric bandpass filter, comprising: an input terminal, an output terminal, and a voltage control terminal; a plurality of dielectric resonators electrically connected between said input terminal and said output terminal; a PIN diode electrically connected to at least one of said plurality of dielectric resonators, said PIN diode being turned on and off by a control signal from said voltage control terminal; a direct-current blocking capacitor electrically connected in series with said PIN diode on the anode side of the same; said voltage control terminal being electrically connected to a point between said PIN diode and said direct-current blocking capacitor; a series circuit comprising said PIN diode and said direct-current blocking capacitor being comprised in a multipath circuit of said bandpass filter.

The present invention further provides a dielectric bandstop filter, comprising: an input terminal, an output terminal, and a voltage control terminal; a plurality of dielectric resonators electrically connected between said input terminal and said output terminal; a variable-capacitance diode whose capacitance can be electrically changed by a control signal from said voltage control terminal; a first capacitor electrically connected in series with said variable-capacitance diode on the cathode side of the same; at least one second capacitor electrically connected in parallel with the series circuit of said variable-capacitance diode and said first capacitor; and a parallel circuit comprising said variable-capacitance diode, said first capacitance and said second capacitance is electrically connected in series with at least one of said plurality of dielectric resonators and being comprised in a trapping circuit of said bandstop filter.

The present invention further provides a dielectric bandstop filter, comprising: an input terminal, an output terminal, and a voltage control terminal; a plurality of dielectric resonators electrically connected between said input terminal and said output terminal; a PIN diode turned on and off by a control signal from said voltage control terminal; at least one capacitor electrically connected in parallel with said PIN diode; and a parallel circuit comprising said PIN diode and said capacitor being electrically connected in series with at least one of said plurality of dielectric resonators and being comprised in a trapping circuit of said bandstop filter.

The present invention further provides a dielectric duplexer, comprising at least one of the above described dielectric filters.

The present invention further provides a communication apparatus comprising at least one of the above described dielectric filters and/or the above described dielectric duplexer.

In the above-described arrangement, an attenuation pole is adjustable by controlling a voltage applied to the voltage control terminal such that the capacitance value of the variable-capacitance diode is changed or the PIN diode is turned on and off, whereby a center frequency of the filter is changed. In the dielectric resonator, the capacitance of the electrically changeable device is not connected in parallel with the dielectric resonator, so that a deterioration in $Q_o$ of the resonant system is limited and the insertion loss is reduced while the amount of attenuation is increased.

Also, a dielectric duplexer in accordance with the present invention has at least one of the dielectric filters having the above-described features, thereby limiting a deterioration in $Q_o$ of the resonant system, reducing the insertion loss and increasing the amount of attenuation.

Further, a communication apparatus in accordance with the present invention has at least one of the dielectric filters and/or the dielectric duplexer having the above-described features.

The communication apparatus can have improved electrical characteristics due to its use of the dielectric filter or dielectric duplexer, free from any considerable deterioration in $Q_o$ of the resonant system and having a small insertion loss and a large amount of attenuation.

Other features and advantages of the present invention will become apparent from the following description of preferred embodiments of the invention which refers to the accompanying drawings, wherein like reference numerals indicate like elements to avoid duplicative description.

PREFERRED EMBODIMENTS OF THE PRESENT INVENTION

Figure 1:
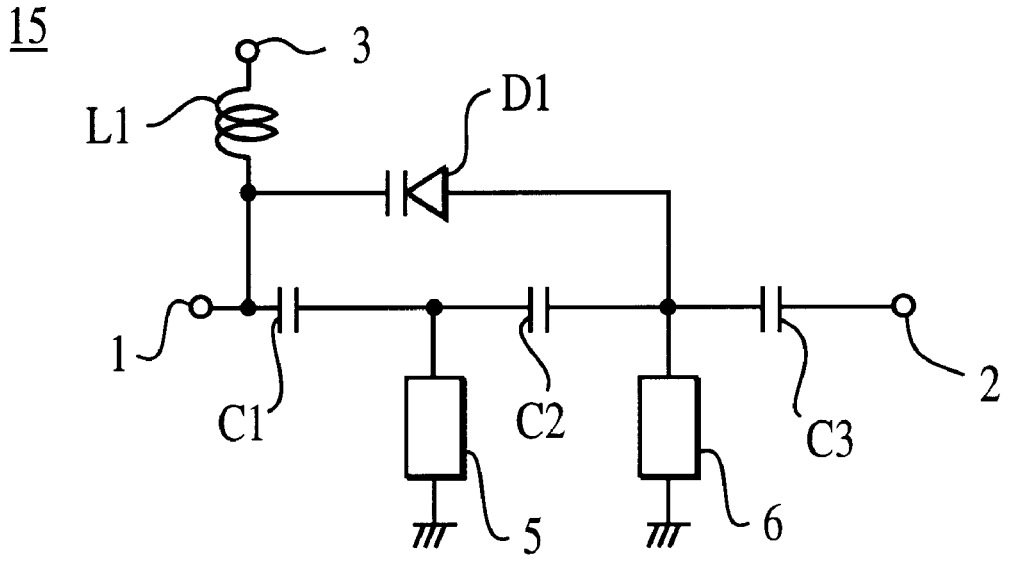
FIG. 1 is an electric circuit diagram showing the configuration of a first embodiment of a dielectric filter in accordance with the present invention.
Figure 2:
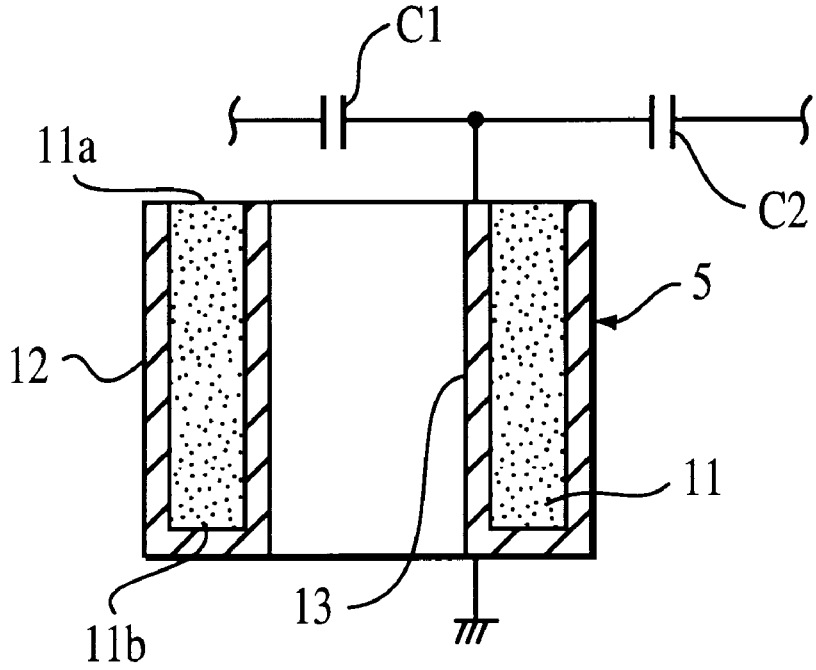
FIG. 2 is a cross-sectional view of an example of a dielectric resonator used in the dielectric filter shown in FIG. 1.
Figure 3:
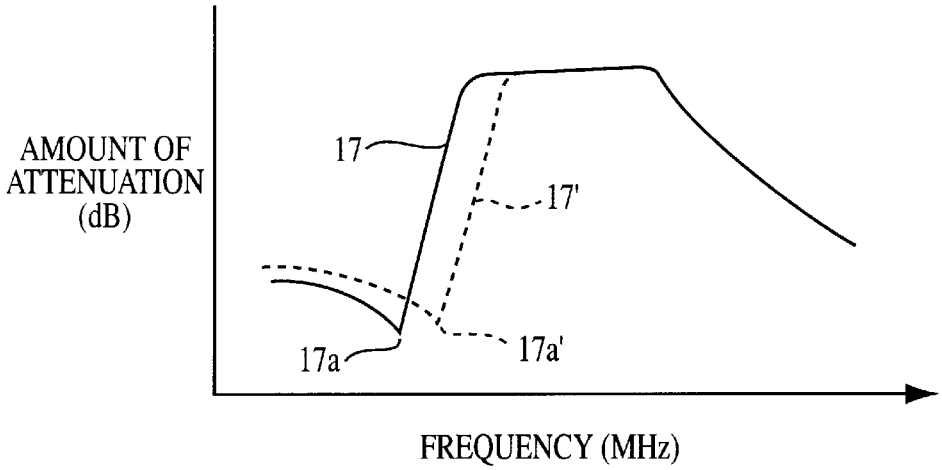
FIG. 3 is a graph showing an attenuation characteristic of the dielectric filter shown in FIG. 1.

[First Preferred Embodiment, FIGS. 1 to 3]

FIG. 1 shows the circuit configuration of a variable-frequency bandpass filter 15 having one attenuation pole. A dielectric resonator 5 is electrically connected to an input terminal 1 through a coupling capacitor C1. A dielectric resonator 6 is electrically connected to an output terminal 2 through a coupling capacitor C3. The dielectric resonators 5 and 6 are electrically connected to each other through a coupling capacitor C2.

A voltage control terminal 3 is electrically connected to the cathode of a variable-capacitance diode D1 and to one end of the coupling capacitor C1 through a choke coil L1. The anode of the variable-capacitance diode D1 is electrically connected to the dielectric resonator 6. That is, the variable-capacitance diode D1 forms a multipath circuit providing a second path between input and output and thereby provides the above-mentioned pole in the filter 15.

FIG. 2 shows an example of a coaxial type resonator which may be used as each of the dielectric resonators 5 and 6. Each of the dielectric resonators 5 and 6 is formed of a cylindrical dielectric member 11 made of a high-dielectric-constant material such as a $TiO_2$ ceramic, an outer conductor 12 provided on the outer cylindrical surface of the cylindrical dielectric member 11, and an inner conductor 13 provided on the inner cylindrical surface of the cylindrical member 11. The outer conductor 12 has an electrically-open (separated) end spaced apart from the inner conductor 13 at one opening end surface 11*a* of the dielectric member 11 (hereinafter referred to as open end surface 11*a*), and is electrically connected to the inner conductor 13 at the other opening end surface 11*b* (hereinafter referred to as short-circuit end surface 11*b*). The coupling capacitors C1 to C3 and the anode of the diode D1 are connected to the inner conductors 13 of the dielectric resonators 5 and 6 at the open end surfaces 11*a* while the outer conductors 12 are grounded at the short-circuit end surfaces 11*b*.

A center frequency of this variable-frequency bandpass filter 15 is determined by the capacitance of the variable-capacitance diode D1 and resonant frequencies of resonant systems formed by the dielectric resonators 5 and 6. A terminal voltage of the variable-capacitance diode D1 is changed by controlling the value of a direct-current voltage of a variable voltage source (not shown) connected to the voltage control terminal 3. With this change, the capacitance of the variable-capacitance diode D1 is changed. For example, as shown in FIG. 3, attenuation pole 17*a* of the filter 15 is thereby moved to the point indicated at 17*a*', with the curve of the attenuation characteristic indicated by the solid line 17 being changed into a curve indicated by the broken line 17', thus changing the center frequency of the filter 15.

Because the variable-capacitance diode D1 is used as a multipath circuit element forming one attenuation pole, and because the variable-capacitance diode D1 is connected to the dielectric resonator 6, the attenuation pole can be changed without connecting the capacitance of the variable-capacitance diode D1 in parallel with the dielectric resonator 6. Therefore, a deterioration in $Q_o$ of the resonant systems can be limited and a small insertion loss and a large amount of attenuation can be achieved.

Figure 4:
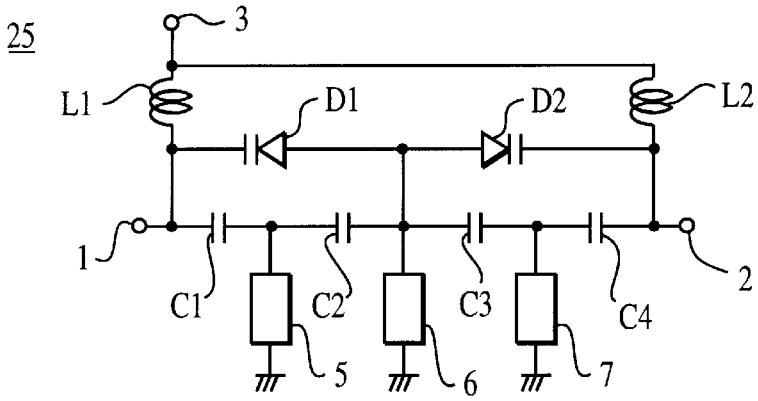
FIG. 4 is an electric circuit diagram showing the configuration of a second embodiment of a dielectric filter in accordance with the present invention.
Figure 5:
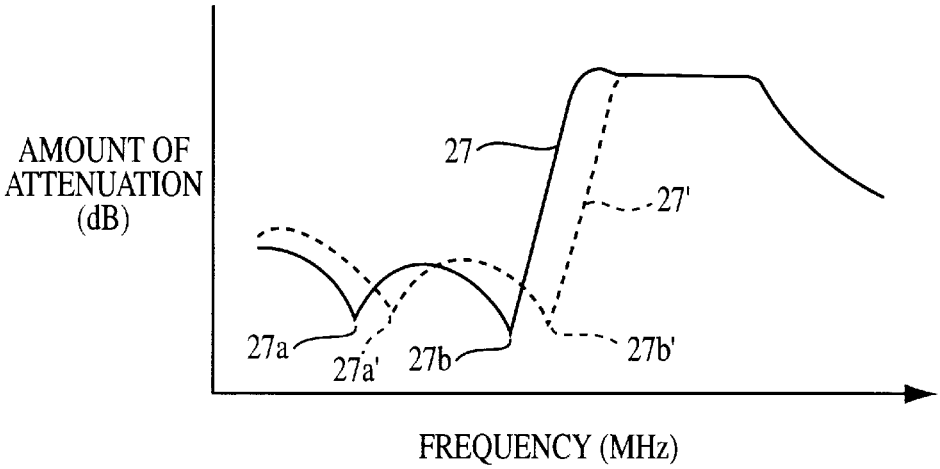
FIG. 5 is a graph showing an attenuation characteristic of the dielectric filter shown in FIG. 4.

[Second Preferred Embodiment, FIGS. 4 and 5]

FIG. 4 shows the circuit configuration of a variable-frequency bandpass filter 25 having two attenuation poles.

Between an input terminal 1 and an output terminal 2, dielectric resonators 5, 6, and 7 form a multistage circuit through coupling capacitors C1, C2, C3, and C4. That is, the input terminal 1 and the dielectric resonator 5 are electrically connected to each other through the coupling capacitor C1; the dielectric resonators 5 and 6 are electrically connected to each other through the coupling capacitor C2; the dielectric resonators 6 and 7 are electrically connected to each other through the coupling capacitor C3; and the output terminal 2 and the dielectric resonator 7 are electrically connected to each other through the coupling capacitor C4.

A voltage control terminal 3 is electrically connected to the cathode of the variable-capacitance diode D1 and to one end of the coupling capacitor C1 through a choke coil L1, and is also connected electrically to the cathode of the variable-capacitance diode D2 and to one end of the coupling capacitor C4 through a choke coil L2. The anodes of the variable-capacitance diodes D1 and D2 are electrically connected to the dielectric resonator 6. That is, the variable-capacitance diodes D1 and D2 form a multipath circuit which provides poles in the filter 25.

A center frequency of this variable-frequency bandpass filter 25 is determined by the capacitances of the variable-capacitance diodes D1 and D2 and resonant frequencies of resonant systems formed by the dielectric resonators 5 to 7. The capacitances of the variable-capacitance diodes D1 and D2 are changed by changing the value of a voltage applied to the voltage control terminal 3. For example, as shown in FIG. 5, two attenuation poles 27*a* and 27*b* of the filter 25 are thereby moved to the points indicated at 27*a*' and 27*b*', with the curve of the attenuation characteristic indicated by the solid line 27 being changed into a curve indicated by the broken line 27', thus changing the center frequency of the filter 25. This variable-frequency bandpass filter 25 operates in the same manner and has the same advantages as the above-described first embodiment filter 15.

Figure 6:
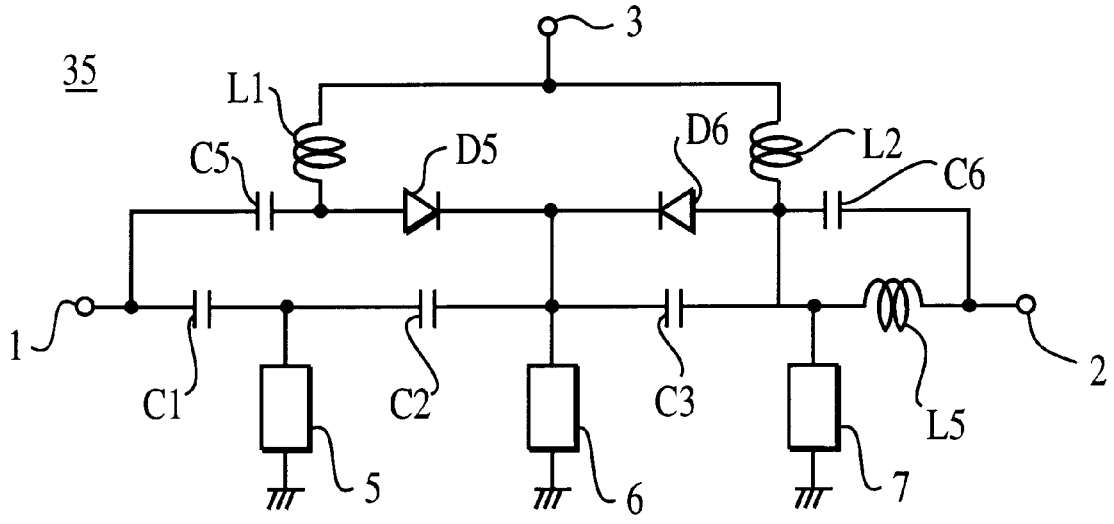
FIG. 6 is an electric circuit diagram showing the configuration of a third embodiment of a dielectric filter in accordance with the present invention.

[Third Preferred Embodiment, FIG. 6]

As shown in FIG. 6, a third embodiment of a variable-frequency bandpass filter 35 has a multipath circuit in which PIN diodes D5 and D6 are respectively connected electrically in series with capacitors C5 and C6 which provide poles in the filter 35 (hereinafter referred to as multipath capacitors C5 and C6). Between an input terminal 1 and an output terminal 2, dielectric resonators 5, 6, and 7 form a multistage circuit through coupling capacitors C1, C2, and C3, and a coupling coil L5. That is, the input terminal 1 and the dielectric resonator 5 are electrically connected to each other through the coupling capacitor C1; the dielectric resonators 5 and 6 are electrically connected to each other through the coupling capacitor C2; the dielectric resonators 6 and 7 are electrically connected to each other through the coupling capacitor C3; and the output terminal 2 and the dielectric resonator 7 are electrically connected to each other through the coupling coil L5. Alternatively, the output terminal 2 and the dielectric resonator 7 may be electrically connected through a coupling capacitor. Attenuation poles are formed on the high-frequency side of the passband in the case where the coupling coil L5 is used while attenuation poles are formed on the low-frequency side of the passband in the case where a coupling capacitor is used.

The series circuit of the multipath capacitor C5 and the PIN diode D5 is connected between the input terminal 1 and the open end surface of the dielectric resonator 6. The series circuit of the multipath capacitor C6 and the PIN diode D6 is connected between the output terminal 2 and the open end surface of the dielectric resonator 6. The multipath capacitors C5 and C6 cut off direct-current components.

A voltage control terminal 3 is electrically connected to the anode of the PIN diode D5 and to one end of the multipath capacitor C5 through a choke coil L1, and is also connected electrically to the anode of the PIN diode D6 and to one end of the multipath capacitor C6 through a choke coil L2. The cathodes of the PIN diodes D5 and D6 are electrically connected to the dielectric resonator 6.

A center frequency of this variable-frequency bandpass filter 35 is determined by the capacitances of the multipath capacitors C5 and C6 and resonant frequencies of resonant systems formed by the dielectric resonators 5 to 7. When a positive voltage is applied as a control voltage to the voltage control terminal 3, the PIN diodes D5 and D6 are turned on. Conduction is thereby caused between the multipath capacitors C5 and C6 and the dielectric resonator 6 via the PIN diodes D5 and D6. Conversely, when a negative voltage is applied as a control voltage, the PIN diodes D5 and D6 are turned off. The multipath capacitors C5 and C6 are thereby isolated from the dielectric resonator 6. Thus, the capacitances of the multipath capacitors C5 and C6 are added to or removed from the dielectric resonator 6 to change multipath circuit constants. That is, the series circuit formed of the PIN diode D5 and the multipath capacitor C5 is used as one multipath circuit element of the filter 35. The series circuit formed of the PIN diode D6 and the multipath capacitor c6 is used as another multipath circuit element of the filter 35. Consequently, attenuation poles of the filter 35 can be moved to change the center frequency.

In the above-described filter 35, the PIN diodes D5 and D6 provided as a multipath circuit element are connected to the dielectric resonator 6, so that a deterioration in resonance system $Q_o$ can be limited and a small insertion loss and a large amount of attenuation can be achieved.

Figure 7:
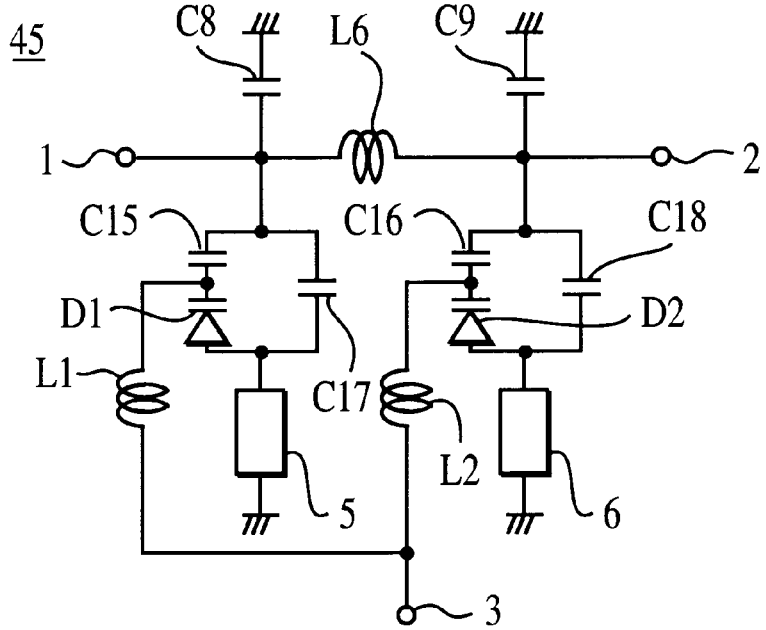
FIG. 7 is an electric circuit diagram showing the configuration of a fourth embodiment of a dielectric filter in accordance with the present invention.

[Fourth Preferred Embodiment, FIG. 7]

As a fourth embodiment, an example of a variable-frequency bandstop filter will be described. As shown in FIG. 7, a variable-frequency bandstop filter 45 has a resonating capacitor C15 electrically connected in series to the cathode of a variable-capacitance diode D1, and has a resonating capacitor C17 connected in parallel with this series circuit of the variable-capacitance diode D1 and the resonating capacitor C15. Similarly, a resonating capacitor C16 is electrically connected in series to the cathode of a variable-capacitance diode D2, and a resonating capacitor C18 is connected in parallel with this series circuit of the variable-capacitance diode D2 and the resonating capacitor C16. The parallel circuit formed of the variable-capacitance diode D1, the resonating capacitor C15 and the resonating capacitor C17 is electrically connected in series to a dielectric resonator 5 while the parallel circuit formed of the variable-capacitance diode D2, the resonating capacitor C16 and the resonating capacitor C18 is electrically connected in series to a dielectric resonator 6, thus forming a trap circuit.

Trap frequencies of this variable-frequency bandstop filter 45 are determined by the resonant frequency of the resonant system formed of the capacitance of the variable-capacitance diode D1, the resonating capacitors C15 and C17 and the dielectric resonator 5 and the resonant frequency of the resonant system formed of the capacitance of the variable-capacitance diode D2, the resonating capacitors C16 and C18 and the dielectric resonator 6. The capacitances of the variable-capacitance diodes D1 and D2 are changed by changing the value of a voltage applied to a voltage control terminal 3 to change trap circuit constants. That is, the parallel circuit formed of the resonating capacitors C15 and C17 and the variable-capacitance diode D1 is electrically connected in series with the dielectric resonator 5 to be used as a trapping capacitor of the filter 45. Also, the parallel circuit formed of the resonating capacitors C16 and C18 and the variable-capacitance diode D2 is electrically connected in series with the dielectric resonator 6 to be used as a trapping capacitor of the filter 45. Attenuation poles of the filter 45 are thereby moved to change the trap frequencies.

Figure 8:
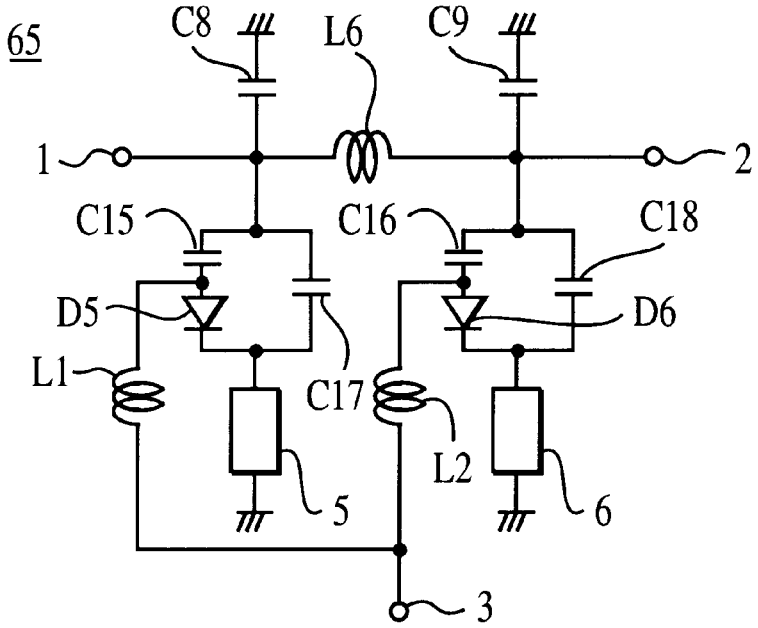
FIG. 8 is an electric circuit diagram showing the configuration of a fifth embodiment of a dielectric filter in accordance with the present invention.

[Fifth Embodiment, FIG. 8]

As shown in FIG. 8, a fifth embodiment of a variable-frequency bandstop filter 65 has a trap circuit formed of resonating capacitors C15 and C17, and C16 and C18 connected in parallel, and PIN diodes D5 and D6 electrically connected in series with the capacitors C15 and C16, respectively.

Trap frequencies of this variable-frequency bandstop filter 65 are determined by the resonant frequency of the resonant system formed of the resonating capacitors C15 and C17 and the dielectric resonator 5 and the resonant frequency of the resonant system formed of the resonating capacitors C16 and C18 and the dielectric resonator 6. When a positive voltage is applied as a control voltage to a voltage control terminal 3, the PIN diodes D5 and D6 are turned on. Conduction is thereby caused between the resonating capacitor C15 and the dielectric resonator 5 via the PIN diode D5 and between the resonating capacitor C16 and the dielectric resonator 6 via the PIN diode D6. Conversely, when a negative positive voltage is applied as a control voltage, the PIN diodes D5 and D6 are turned off. The resonating capacitors C15 and C16 are thereby isolated from the dielectric resonators 5 and 6.

The capacitances of the resonating capacitors C15 and C16 are thereby added to or removed from the dielectric resonators 5 and 6 to change trap circuit constants. That is, the parallel circuit formed of the resonating capacitors C15 and C17 and the PIN diode D5 is electrically connected in series with the dielectric resonator 5 to be used as a trapping capacitor of the filter 65. Also, the parallel circuit formed of the resonating capacitors C16 and C18 and the PIN diode D6 is electrically connected in series with the dielectric resonator 6 to be used as a trapping capacitor of the filter 65. Attenuation poles of the filter 45 are thereby moved to change the trap frequencies.

Figure 9:
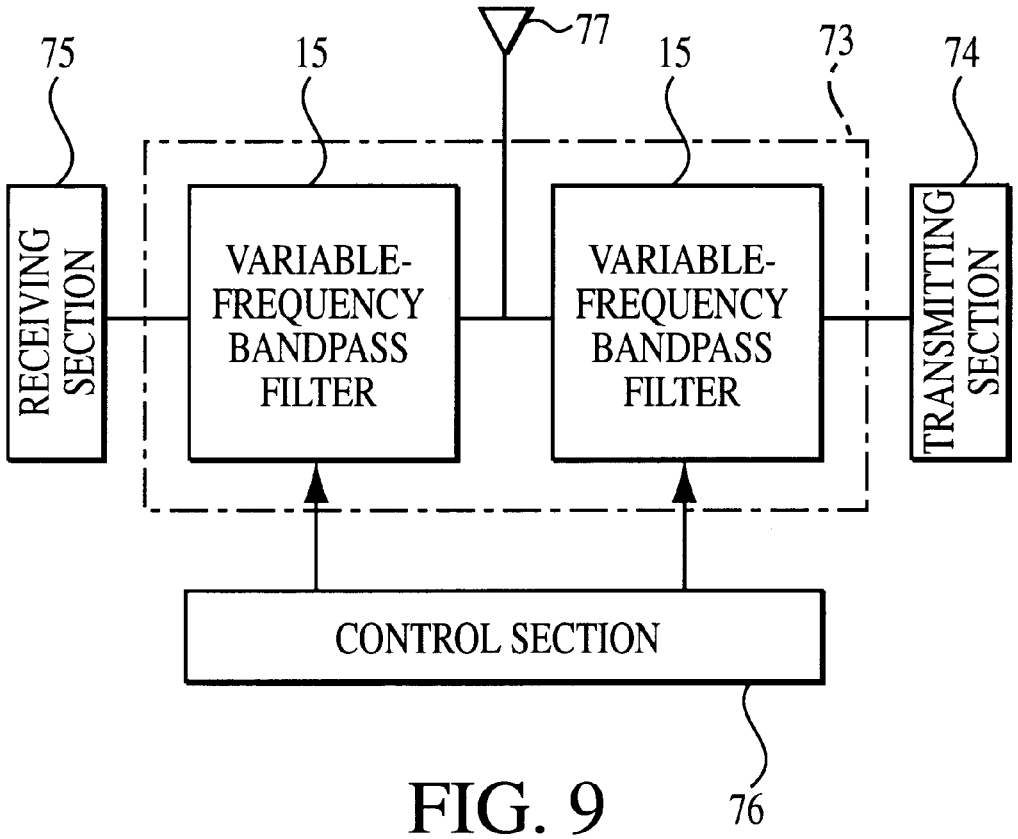
FIG. 9 is an electric circuit block diagram showing an embodiment of a dielectric duplexer in accordance with the present invention.

[Sixth Preferred Embodiment, FIG. 9]

The sixth embodiment is an example of a dielectric duplexer in accordance with the present invention.

As shown in FIG. 9, a dielectric duplexer 73 is formed by combining two variable-frequency bandpass filters 15 described above as the first embodiment. For example, this dielectric duplexer 73 is used to perform bi-directional communication in a motor vehicle telephone system or the like. Different frequency bands are determined as the frequency bands to be used for transmitting and receiving. In FIG. 9, a component 74 is a transmitting section, a component 75 is a receiving section, a component 76 is a control section for changing the center frequency of each filter 15 to a desired frequency by changing a voltage at a terminal of a variable-capacitance diode D1 included in the filter 15, and a component 77 is a transmitting and receiving antenna. Needless to say, while two filters 15 are combined in the sixth embodiment, any two of the variable-frequency bandpass filters 15, 25, and 35 described above as the first to third embodiments may be combined to form a dielectric duplexer.

Figure 10:
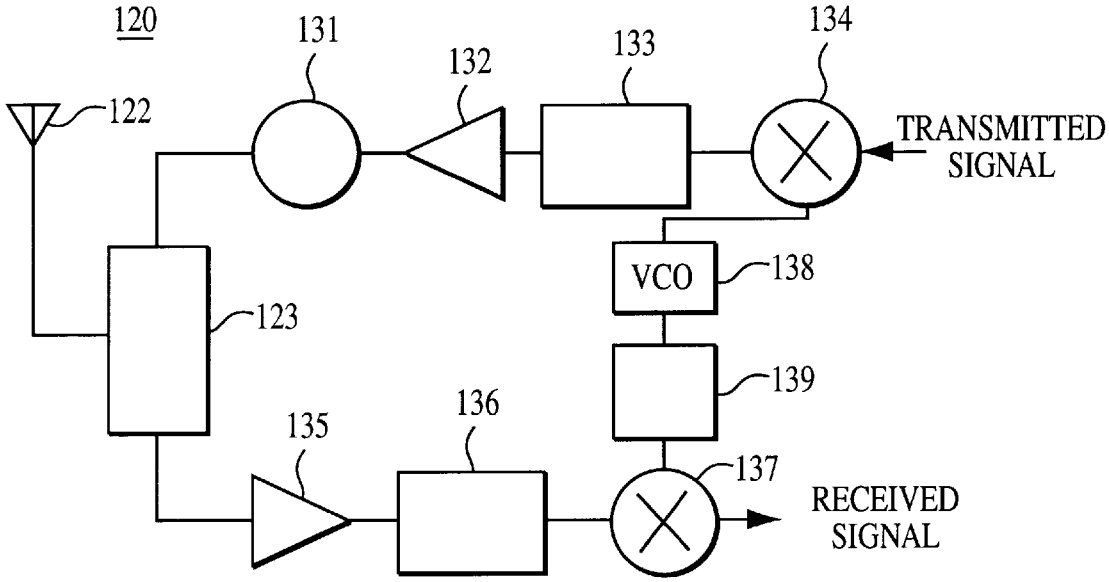
FIG. 10 is an electric circuit block diagram showing an embodiment of a communication apparatus in accordance with the present invention.
Figure 11:
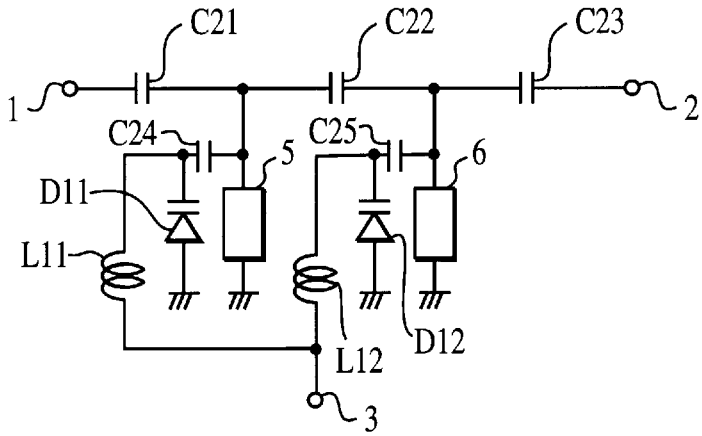
FIG. 11 PRIOR ART
FIG. 11 is an electric circuit diagram showing the configuration of a conventional dielectric filter.
Figure 12:
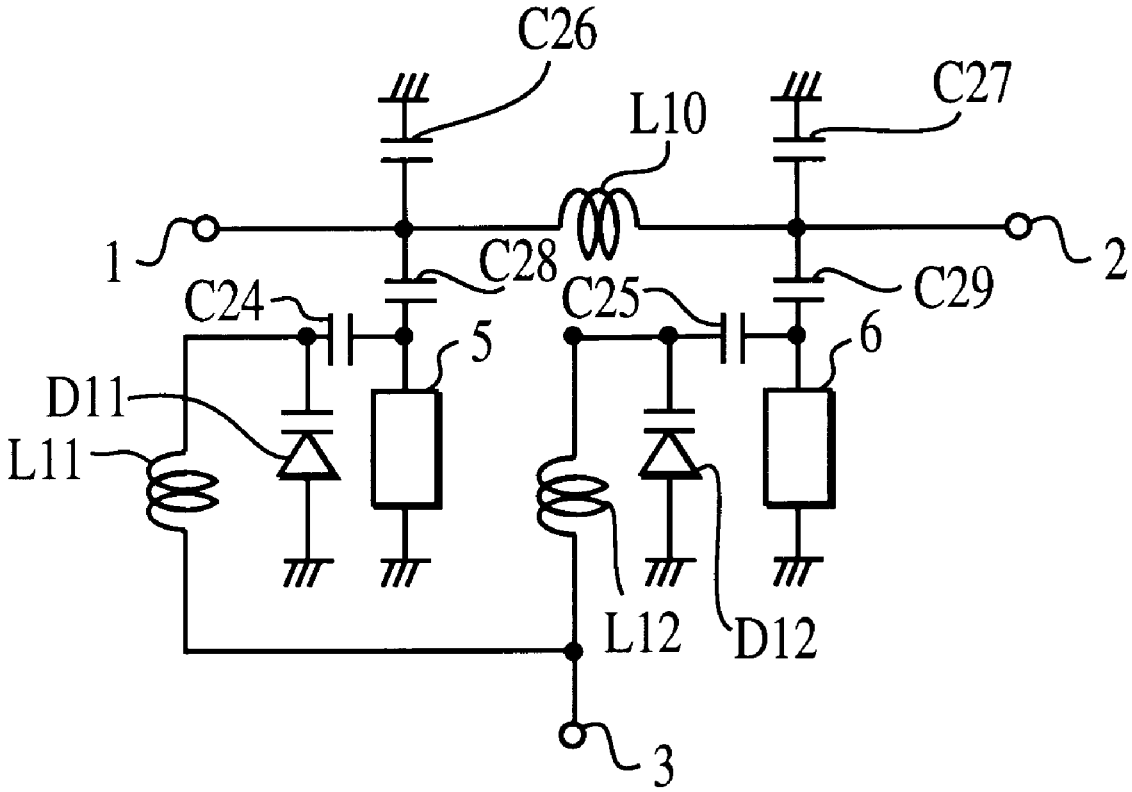
FIG. 12 PRIOR ART
FIG. 12 is an electric circuit diagram showing the configuration of another conventional dielectric filter.

[Seventh Preferred Embodiment, FIG. 10]

The seventh embodiment is a communication apparatus in accordance with the present invention, which will be described as a portable telephone set by way of example.

FIG. 10 is an electrical circuit block diagram of an RF section of a portable telephone set 120. In FIG. 10, a component 122 is an antenna element, a component 123 is an antenna sharing filter (duplexer) 123, a component 131 is a transmitting-side isolator, a component 132 is a transmitting-side amplifier, a component 133 is a transmitting-side interstage bandpass filter, a component 134 is a transmitting-side mixer, a component 135 is a receiving-side amplifier, a component 136 is a receiving-side interstage bandpass filter, a component 137 is a receiving-side mixer, a component 138 is a voltage control oscillator (VCO), and a component 139 is a local bandpass filter.

For example, the above-described fifth embodiment of a dielectric duplexer 73 can be used as antenna sharing filter (duplexer) 123. Further, for example, each of the dielectric filters 15, 25, and 35 described above as the first to third preferred embodiments can be used as transmitting-side and receiving-side interstage bandpass filters 133 and 136 and local bandpass filter 139.

The dielectric filter, the dielectric duplexer and the communication apparatus of the present invention are not limited to the above-described embodiments, and can be variously modified within the scope of the invention.

While the invention has been particularly shown and described with reference to preferred embodiments thereof, it will be understood by those skilled in the art that the foregoing and other changes in form and details may be made therein without departing from the spirit of the invention.

What is claimed is:

1. A communication apparatus comprising:

a variable-frequency bandstop filter, said bandstop filter having:

an input terminal, an output terminal, and a voltage control terminal;

a plurality of dielectric resonators electrically connected in a circuit which interconnects said input terminal and said output terminal;

a variable-capacitance diode connected to said voltage-control terminal whose capacitance can be electrically changed by a control signal from said voltage control terminal;

a first capacitor electrically connected in series with said variable capacitance diode on the cathode side of said variable-capacitance diode;

at least one second capacitor electrically connected in parallel with the series circuit of said variable-capacitance diode and said first capacitor; and said parallel circuit comprising said variable-capacitance diode, said first capacitor and said second capacitor is electrically connected in series with one of said plurality of dielectric resonators; and said series circuit which comprises said parallel circuit and said one of said plurality of dielectric resonators provides a trapping circuit of said bandstop filter, thereby providing an attenuation pole of said bandstop filter.

2. A communication apparatus comprising:

a variable-frequency bandpass filter, said bandpass filter having:

an input terminal, an output terminal, and a voltage control terminal;

a plurality of dielectric resonators electrically connected in a circuit which interconnects said input terminal and said output terminal;

a PIN diode electrically connected in series to at least one of said plurality of dielectric resonators and to said voltage-control terminal, said PIN diode being turned on and off by a control signal from said voltage control terminal;

a direct-current blocking capacitor electrically connected in series with said PIN diode on the anode side of said PIN diode;

said voltage control terminal being electrically connected to a junction point between said PIN diode and said direct-current blocking capacitor;

a series circuit comprising said PIN diode and said direct-current blocking capacitor comprising a circuit path interconnecting at least two of said plurality of dielectric resonators of said bandpass filter and thereby providing an attenuation pole of said bandpass filter.

3. A communication apparatus comprising at least one variable-frequency bandpass filter according to claim 2.

4. A communication apparatus according to claim 2, further comprising:

a second bandpass filter having an input terminal and an output terminal, one respective terminal of each of said variable-frequency bandpass filter and said second bandpass filter being connected to an antenna terminal for being connected to an antenna circuit, the other terminal of one of said filters being for connection to a transmitting section, and the other terminal of the other of said filters being for connection to a receiving section.

5. A communication apparatus according to claim 4, further comprising an antenna circuit connected to said antenna terminal, a transmitting section connected to said other terminal of said one of said filters, and a receiving section connected to said other terminal of said other of said filters.

6. A communication apparatus according to claim 2, wherein said junction point is connected to said voltage-control terminal via a choke coil.

7. A communication apparatus according to claim 2, wherein said series circuit is further connected to one of said input terminal and said output terminal.

8. A communication apparatus according to claim 7, wherein said blocking capacitor connects said junction point to said one of said input terminal and said output terminal.

9. A communication apparatus according to claim 2, further comprising a second PIN diode electrically connected to at least one of said plurality of dielectric resonators and to said voltage-control terminal, said second PIN diode being turned on and off by a control signal from said voltage control terminal;

a second direct-current blocking capacitor electrically connected in series with said second PIN diode on the anode side of said second PIN diode;

said voltage control terminal being electrically connected to a second junction point between said second PIN diode and said second direct-current blocking capacitor;

a series circuit comprising said second PIN diode and said second direct-current blocking capacitor comprising a second circuit path interconnecting at least two of said plurality of dielectric resonators of said bandpass filter.

10. A communication apparatus according to claim 9, wherein said second junction point is connected to said voltage-control terminal via a choke coil.

11. A communication apparatus according to claim 9, wherein said series circuit comprising said second PIN diode and said second direct-current blocking capacitor is further connected to one of said input terminal and said output terminal.

12. A communication apparatus according to claim 11, wherein said second blocking capacitor connects said second junction point to said one of said input terminal and said output terminal.

13. A communication apparatus comprising:

a variable-frequency bandpass filter, said bandpass filter having:

an input terminal, an output terminal, and a voltage control terminal;

a plurality of dielectric resonators electrically connected in a circuit which interconnects said input terminal and said output terminal;

a variable-capacitance diode electrically connected to at least one of said plurality of dielectric resonators and to said voltage-control terminal, the capacitance of said variable-capacitance diode being electrically changeable by a control signal from said voltage control terminal; and said variable-capacitance diode comprising a respective path interconnecting at least two of said plurality of dielectric resonators of said bandpass filter;

a second variable-capacitance diode electrically connected to at least one of said plurality of dielectric resonators and to said voltage-control terminal, the capacitance of said variable-capacitance diode being electrically changeable by a control signal from said voltage control terminal; and said second variable-capacitance diode comprising a respective second path interconnecting at least two of said plurality of dielectric resonators of said bandpass filter, wherein said path and said second path provide respective attenuation poles of said bandpass filter.

14. A communication apparatus according to claim 13, wherein said second variable-capacitance diode is connected to said voltage-control terminal via a choke coil.

15. A communication apparatus according to claim 13, wherein said second variable-capacitance diode is further connected to one of said input terminal and said output terminal.

16. A communication apparatus according to claim 15, wherein said second variable-capacitance diode is connected to said voltage-control terminal via a choke coil, and a junction between said variable-capacitance diode and said choke coil is connected to said one of said input terminal and said output terminal.

17. A communication apparatus comprising:

a variable-frequency bandstop filter, said bandstop filter having:

an input terminal, an output terminal, and a voltage control terminal;

a plurality of dielectric resonators electrically connected in a circuit which interconnects said input terminal and said output terminal;

a PIN diode connected to said voltage-control terminal for being turned on and off by a control signal from said voltage control terminal;

at least one capacitor electrically connected in parallel with said PIN diode; and a parallel circuit comprising said PIN diode and said capacitor being electrically connected in series with at least one of said plurality of dielectric resonators; and said series circuit which comprises said parallel circuit and said one of said plurality of dielectric resonators providing a trapping circuit of said bandstop filter.

* * * * *